United States Patent [19]

Urdanoz

[11] 4,101,164

[45] Jul. 18, 1978

[54] FOLDING SEAT AND TABLE UNIT

[75] Inventor: Luis Vega Urdanoz, Urnieta (Guipuzcoa), Spain

[73] Assignee: Manufacturas Vega S.A., Urnieta, Spain

[21] Appl. No.: 753,584

[22] Filed: Dec. 22, 1976

[30] Foreign Application Priority Data

| | | | |
|---|---|---|---|
| Dec. 24, 1975 | [ES] | Spain | 443862 |
| May 5, 1976 | [ES] | Spain | 447601 |
| Mar. 29, 1976 | [ES] | Spain | 446460 |
| Jan. 8, 1976 | [ES] | Spain | 217905 |

[51] Int. Cl.[2] ..... A47B 1/08; A47B 3/14

[52] U.S. Cl. ..... 297/159; 108/65; 108/113; 108/67

[58] Field of Search ..... 297/159, 158, 142, 141; 108/100

[56] References Cited

U.S. PATENT DOCUMENTS

| | | | |
|---|---|---|---|
| 553,108 | 1/1896 | Davison | 297/142 |
| 1,557,300 | 10/1925 | Lucus | 297/142 |
| 2,706,835 | 4/1955 | Ullom | 108/99 X |
| 3,055,705 | 9/1962 | Wilson | 297/159 |
| 3,099,481 | 7/1963 | Bue | 297/159 |
| 3,337,262 | 8/1967 | Katzfey et al. | 297/159 |
| 3,511,532 | 5/1970 | Tringali et al. | 297/159 |
| 3,715,143 | 2/1973 | Gerken et al. | 297/159 |

FOREIGN PATENT DOCUMENTS

| | | | |
|---|---|---|---|
| 1,194,957 | 5/1959 | France | 297/142 |

*Primary Examiner*—Francis K. Zugel

*Attorney, Agent, or Firm*—Eyre, Mann, Lucas & Just

[57] ABSTRACT

The present invention is for an integral folding seat and table unit in which the seats are mounted on arms which rotate about a vertical axis on legs of the table and the seats themselves rotate about the arms from the horizontal to the vertical position during folding of the table and seats.

14 Claims, 19 Drawing Figures

FOLDING SEAT AND TABLE UNIT

The present invention is in line with those that attempt to find solutions to the space problem which arises in modern dwellings or living accommodation for man, since these are ever increasingly limited, not so much because of the ever decreasing dimensions of rooms in use, but rather because of the ever increasing requirements experienced by the human being for comfort and wellbeing, which take the form of the acquisition of household appliances, belongings, and utensils, with the resulting problem of their location.

Such is what happens for example in dwellings of the type called "studios," where the sole room in them is required to fulfil the purpose of a work-room, a dining room, a reception room, a bedroom, as well as being used to house bookshelves, etc., and such is what happens too in kitchens; that room in the house where constant development takes place, and which accommodates the refrigerator, the deep-freezer, the larder, the fitted oven, the cooking surface, the smoke extractor hood, etc., etc., all integrated into an assembly made up from these appliances and from the furniture into which they are fitted, and where this furniture is used in addition for storing in an orderly fashion, non-perishable foods, spices and condiments, utensils, crockery, etc., etc.

The accumulation of things which comprise the equipment in a modern kitchen is such that it becomes necessary to find integrated or compact design solutions; that is to say, it sometimes becomes necessary to resort to locating appliances and pieces of furniture above one another, and to pursue the development of the arrangement in the vertical plane, in order to find space for all the items the kitchen is required to have in it.

In these circumstances there is the additional and extremely complex problem created by the absolute necessity of having a dining area inside the kitchen; this being a compelling need, bearing in mind the growing pace in the way of life, and the progressive disappearance of domestic help, which together make it quite impractical to serve daily meals in the dining-room.

There are admittedly solutions in the form of folding tables of all kinds, and there is even the type that can be hidden away inside a cupboard. What is clear, however, is that they do not solve the whole problem. That is to say, they provide a solution whereby the space taken up by the table itself may be reduced; but as regards the chairs, it remains for such solutions as folding chairs having to be resorted to, whereupon these are stowed away in any spare corner in the kitchen, or for the chairs to be brought into the kitchen from other rooms in the house.

This in fact is the way things have been done up to now.

A similar description could be given of what happens in another room intended for a sole purpose (such as the dining-room) when it becomes necessary to equip it for some other purpose different from the intended one.

It is in circumstances such as these that the solution provided by the present invention can be brought into use, wherein the tables and the chairs are conjoined into a firm and articulated assembly, that can be collapsed by automatic or manual action, and which may be stored either as an independent and separate item in the room, or contained inside a piece of furniture for general use.

This solution overcomes all the drawbacks and all the present difficulties in this field, regardless of whether it is constructed in a semi-automatic hand operated version, or in the automatic version.

Surprisingly interesting is the hand operated table and chairs assembly constructed in accordance with the above-mentioned solution, inasmuch as the assembly comprising the table and chairs is opened out by means of a manually applied force, until it adopts its operation position, and where inversely, from this position, with no need other than to apply a simple force to the system, the seat and table unit folds, following a certain order among the component parts, until it adopts the fully folded or stowed position. Or there can be an alternative version, of an even more manual nature, wherein the table is first unfolded, and afterwards the action is applied to the chairs or seats, to make them unfold and adopt the position required for use, and likewise inversely. Surprisingly interesting too is the construction with automatic operation, comprising a table and a set of chairs conjoined and articulated together making up a single and inseparable unit, which by means of a simple impulse, may be put into motion so that both table and chairs fold up by themselves in a predetermined order, with no effort whatsoever being required apart from simply pressing a button, until the assembly adopts its fully folded position, in a manner whereby the folded chairs are accommodated inside the table, which in itself is folded too, and whereby inversely, by pressing the button, this assembly of table and chairs will unfold until it adopts its operation position.

Figure 1:
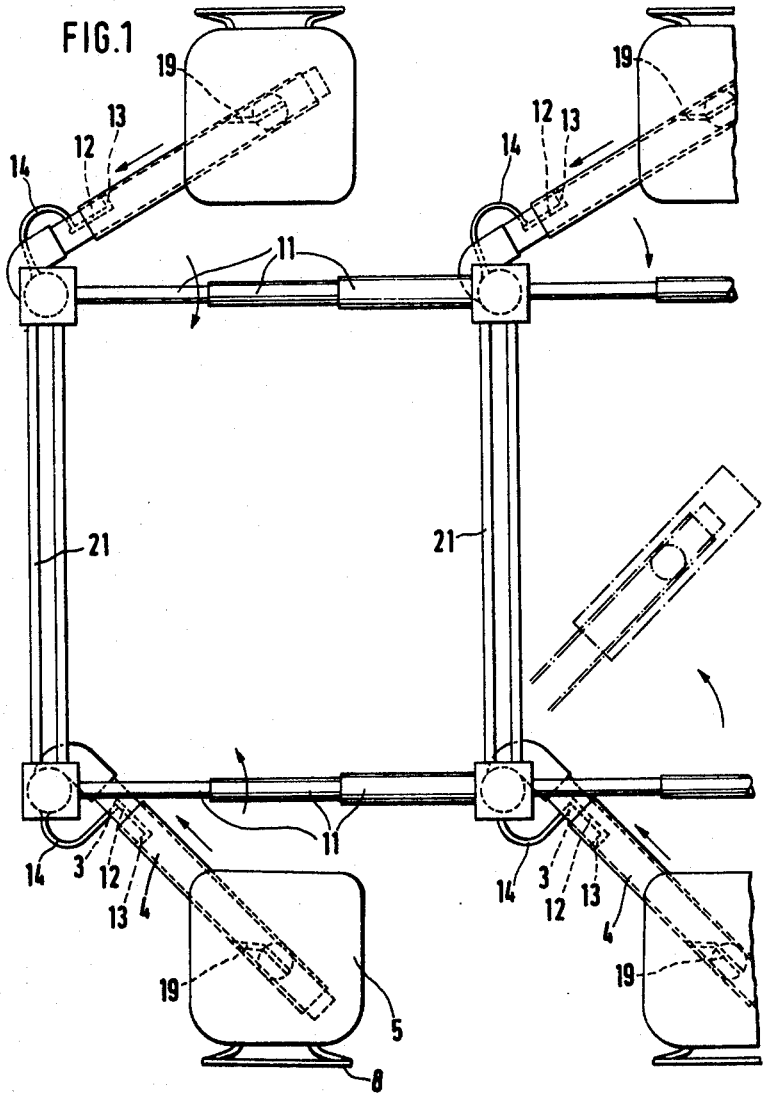
FIG. 1 is a plan view of part of the assembly covered by the present invention, showing the actual arrangements of parts at different points in the structure, where, for the sake of clarity, the top of the table has been omitted.
Figure 2:
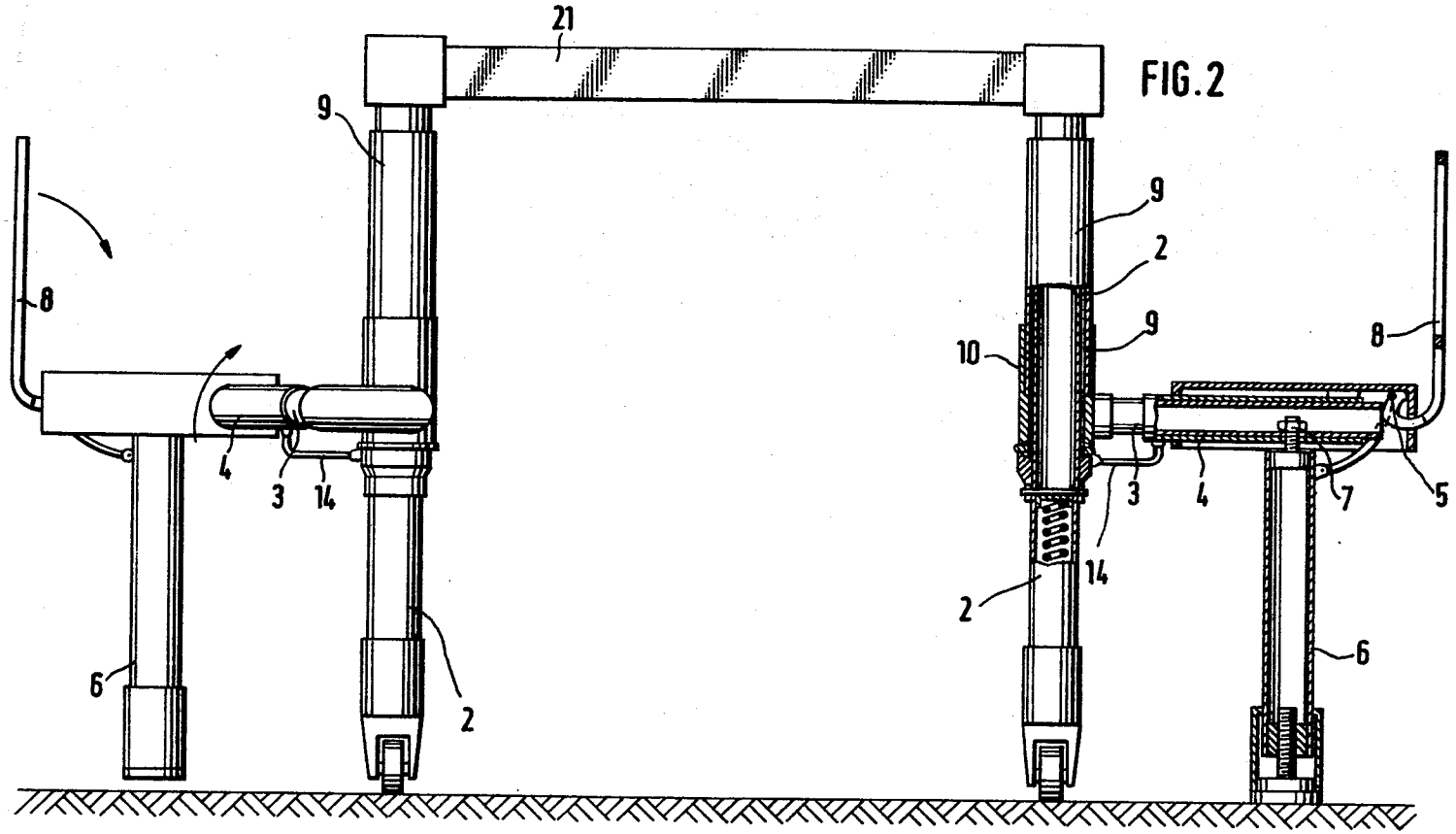
FIG.2 is an end view of the assembly comprising the present invention, where one of the chairs is shown in section, and where its connection to the leg of the table may be seen.
Figure 3:
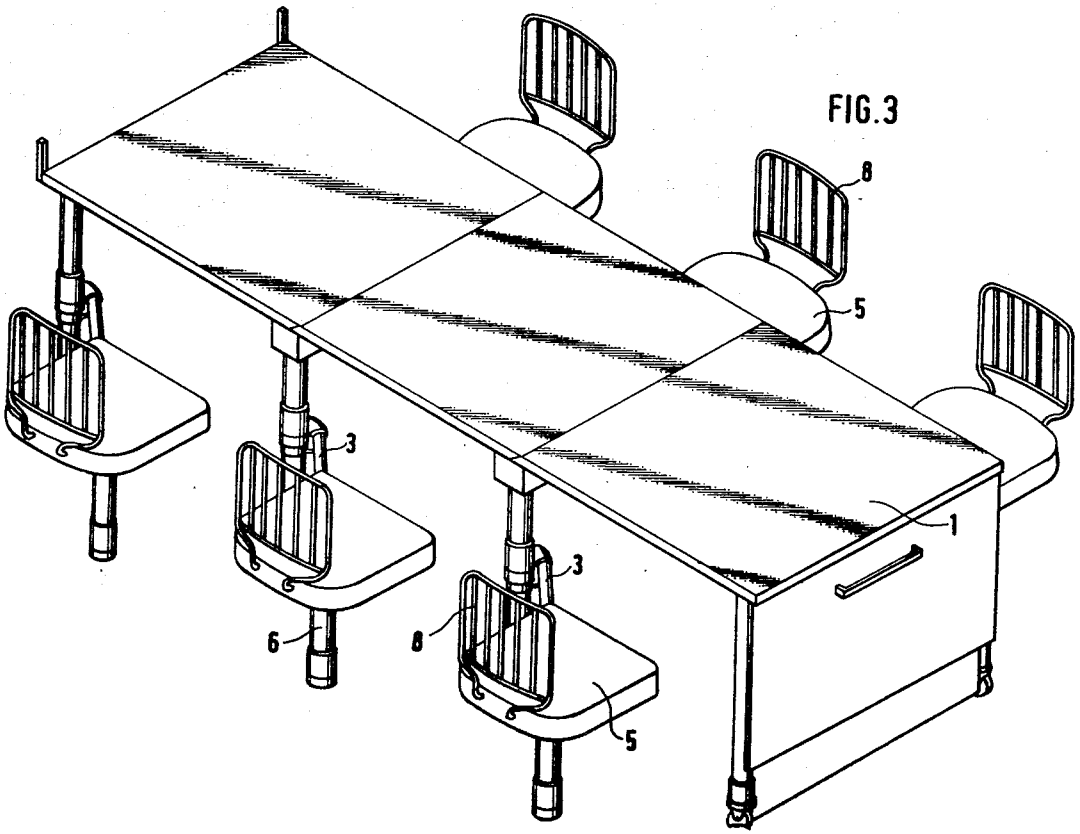
FIGS. 3 and 4 are each perspective views of a construction made in accordance with this invention, shown in the unfolded and folded positions respectively.
Figure 4:
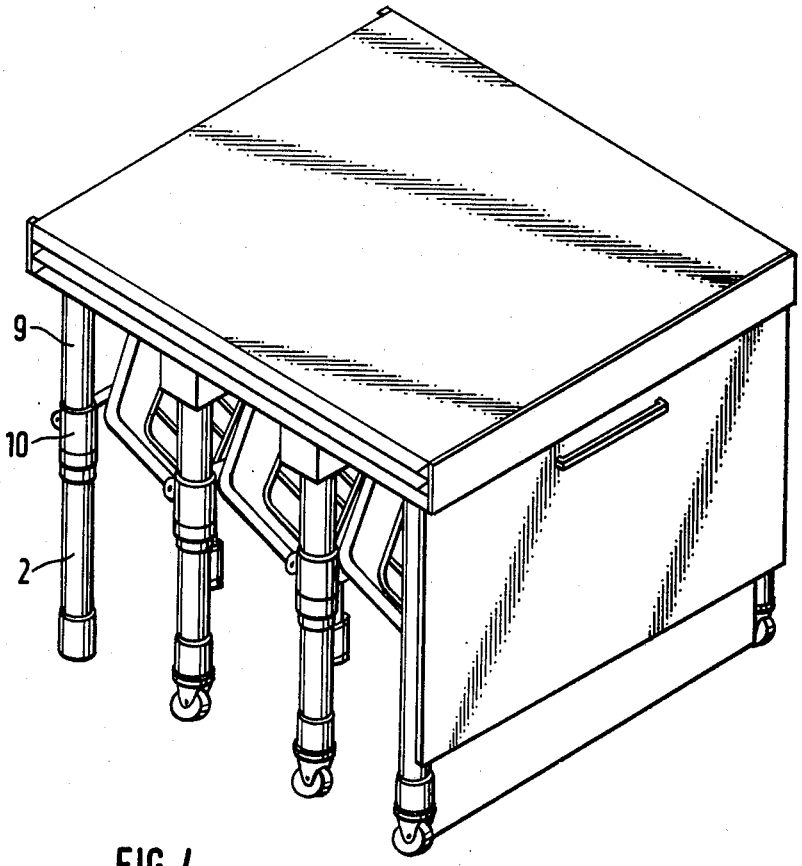
Figure 5:
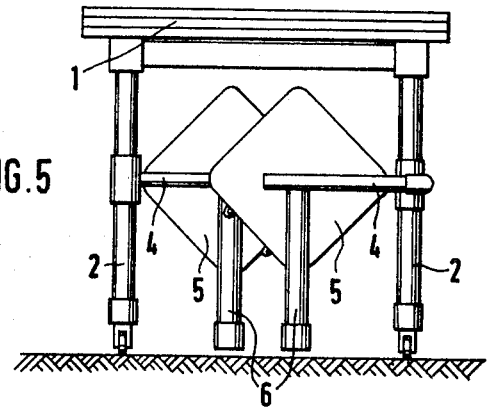
FIG. 5 is an end view of the assembly in the fully folded position.

In accordance with this invention, chairs 5 are conjoined to the table to comprise together a single assembly, in which the seats 5 belonging to each section of table are connected to the structure 1 thereof, making up an articulated unit, by means of mechanical revolving and/or sliding joining pieces 3, which allow each seat 5 and its back-rest 8, if fitted, to be folded and accommodated inside the structure of the table, where they are concealed in a convenient position and location, all in such a way to allow the whole assembly to be folded up to form a single inseparable articulated unit, which takes up a small amount of space, see FIGS. 4 and 5.

The subject of this invention may be applied to any kind of folding table structure, and any kind of table top may be used, being either made of slats, divided into sections, or of any other design, the one illustrated being a non-limitative example, and where in any case, the seats 5 are joined to points on this structure, so that when they are in the open position, they are arranged at each of the different sections thereof, whilst upon adopting the folded position they are clustered into the structure in the course of the folding process of this itself, and they are drawn near to one another, so that the assembly adopts a different size in the course of an initial motion which is an implicit part of the folding and unfolding travel of the structure 1 itself of the table, while the process for folding the assembly is completed with the motions whereby the seats 5 are folded.

In accordance with this invention, seat 5 is suspended in an overhanging fashion from an outside support 2 by means of a holding arm 3, which is arranged so that it supports seat 5 diagonally from below, and it extends horizontally as far as support 2, where it is joined to sleeve members 9 and 10 which are attached together and arranged to swivel freely about said support 1, in this particular case by means of a bearing washer resting upon a seating sleeve which is attached to support 2. However, the upper sleeve member 9 and 10, which is joined to the lower one carrying the holding arm 3, is provided with a helical slot 15 having a uniform section and an expansion towards the right and the left at its lower end 18, and where said helical slot 15 belonging to the upper cylindrical sleeve 9 is in line with another slot 16 which is rectilineal and vertical, in the body of support 2, where both said slots 15 and 16 accommodate a single pin or shaft 17 which is attached solidly to a fitted part arranged to slide inside support 1, being held with a clamp to a plunger-guide, for example, housed in the inside of this support 1, in such a manner that the inside component comprises a sliding guide for pin 18, which being rooted thereon, protrudes outwards through the vertical slot 16 in support 2, and through the helical slot 15 in the upper cylindrical sleeve 9, so that the vertical reciprocating and guided motion of said pin 17 causes the upper cylindrical sleeve 9 to revolve, and the lower cylindrical sleeve 10 to revolve with it, and therefore to make the holding arm 3 attached thereto undergo a radial motion, all as the result of the rubbing of pin 17 upon the edges of the helical slot 15 in the upper sleeve 9, and such motion causes the seat 5 to travel in an arc from its outward position to its inward position, that is to say, travel of pin 17 upwards or downwards in the vertical plane causes seat 5 to travel through an arc from one position to another.

For these purposes, pin 17 is provided with an appropriate head to enable it to be linked to the plunger in an actuating cylinder having a reciprocating motion in the vertical plane brought about by electrical, hydraulic or pneumatic impulses, such as for mechanical linkage with a tie rod 20 connected to the unfolding and folding mechanism for a table, see FIG. 4, so that upon there being an operation from outside, the seat 5 would be made to describe an arc about the support 2, on the understanding that such outside operation may be manual or derived from automatic means or even as the result of the folding or unfolding operation of other pieces of furniture, such as that of the table, for example, whose legs may be comprised of supports 2 carrying seats 5.

Figure 6:
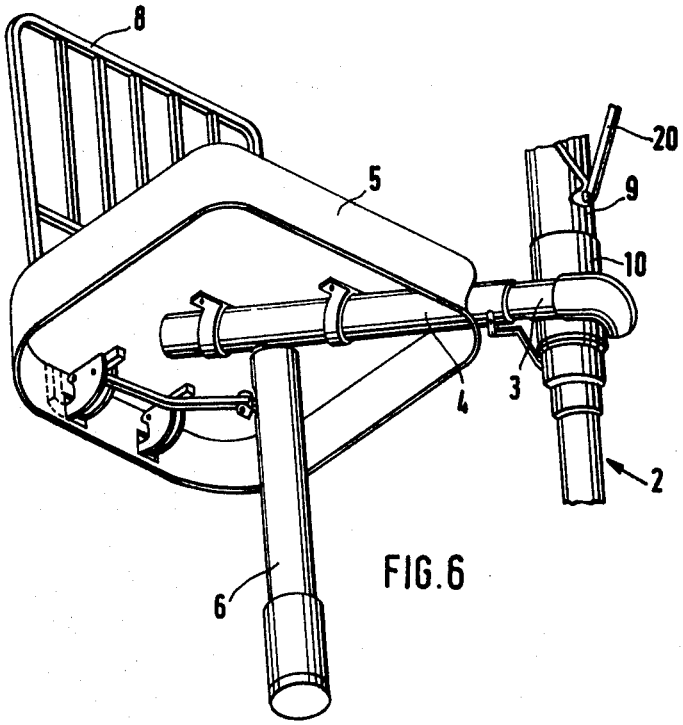
FIG. 6 is a perspective view from beneath a seat incorporating the improvements disclosed under the present invention, where this seat is in the unfolded position ready for use.
Figure 8:
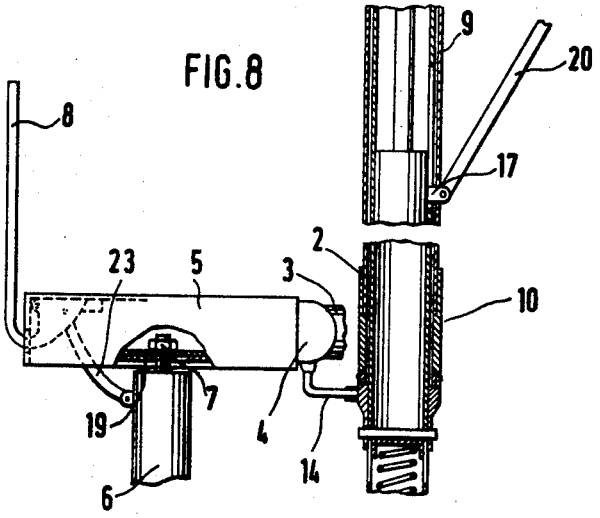
FIG. 8 is an end view of the above, with partial sections.
Figure 7:
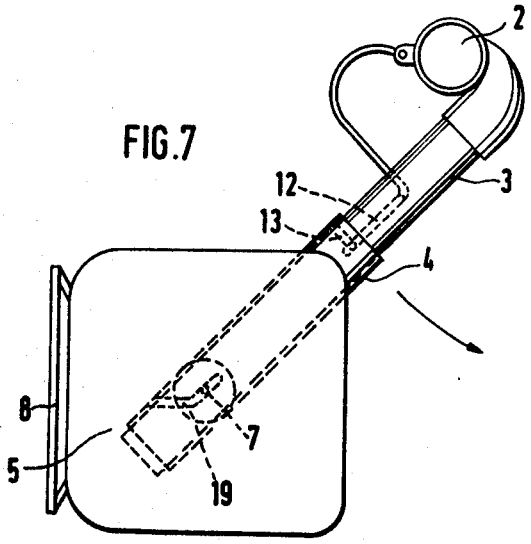
FIG. 7 is a plan view of the arrangement with the seat in the unfolded position.

The holding arm 3 however is not directly linked to the seat 5, but instead is enclosed inside a tubular member 4, it being this latter which supports the seat, being attached to it by means of clamps, see FIG. 6, with the peculiarity that there is a single leg 6 arranged in the vertical plane of the seat 5 having a link 7 which comprises the join from said leg 6 to the holding arm 3, where such join is made through a helical slot 19 in the tubular member 4. There is moreover provided a connecting piece 14, one of whose ends is attached to support 2, at its seating sleeve, for example, while its opposite end is attached to a sliding member whose sliding motion tales place within a longitudinal groove 12 in the holding arm 3, but where such connecting piece 14 goes through an annular groove 13 on the tubular member 4, in such a way that due to the eccentricity of connecting piece 14, its end that is attached to the tubular member 4 and to the holding arm 3, will be positioned at a varying distance from support 2, according to whether holding arm 3 is in one angular position or another, so that in this way it causes the seat 5 to tip over and to travel in a radial direction whilst the assembly is being operated to change it from the open to the folded position, and vice-versa.

Figure 9:
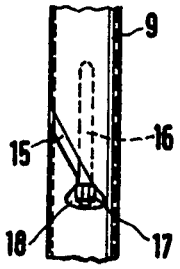
FIG. 9 is a side elevation of the upper part of the support shown by the end elevation in FIG. 8.
Figure 10:
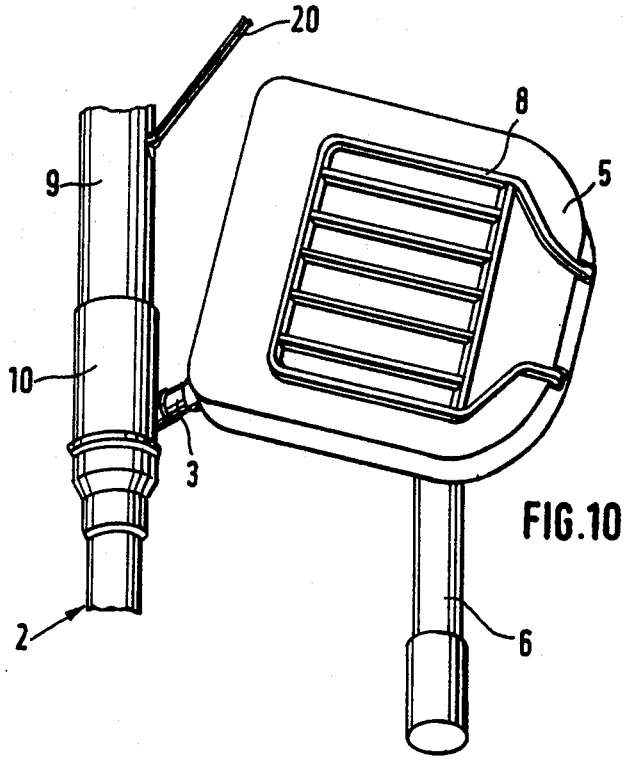
FIG. 10 is a perspective view of the subject of the present invention, in the folded position.
Figure 11:
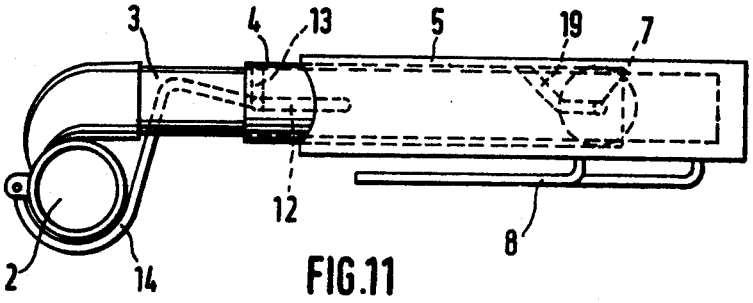
FIG. 11 is the corresponding plan view.
Figure 12:
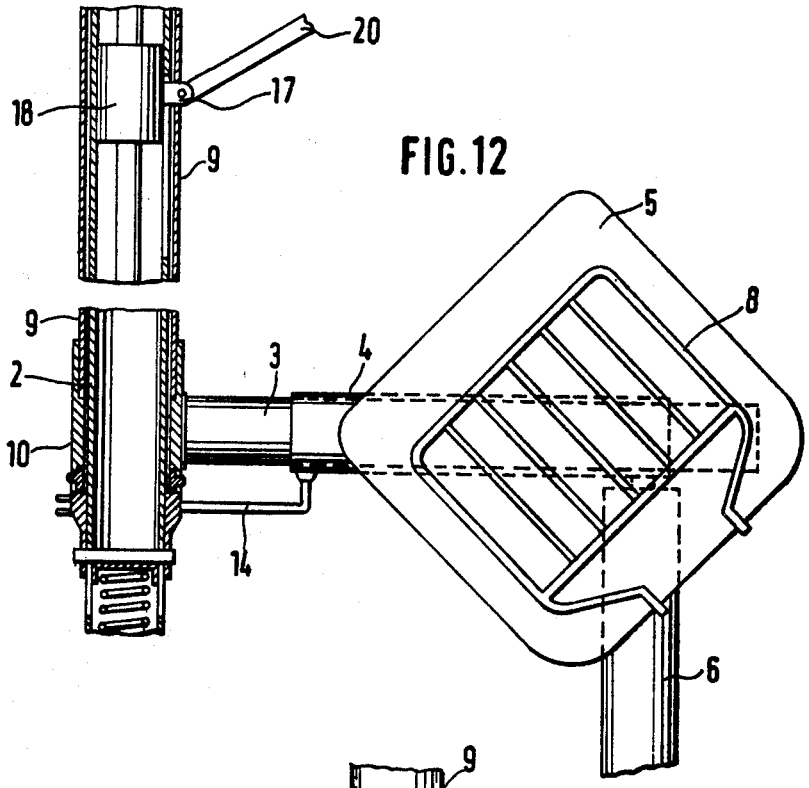
FIG. 12 is the corresponding end elevation, with the support shown partially in section.
Figure 13:
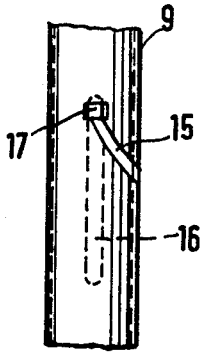
FIG. 13 is a side elevation of the upper part of the support shown by the end elevation in FIG. 12.

The open position is in fact achieved through downward travel of pin 17, and the engagement therewith of the lower expansion 18 in the helical slot 15 made in the upper sleeve 9 of support 1, see FIG. 9, whilst the remaining members take up positions relative to one another, as are shown in FIGS. 6,7, 8 and 9; that is to say, seat 5 is, as may be appreciated, in the position suitable for use as such. When an outside action is applied so as to make pin 17 rise, such as for example a pull exerted on tie rod 20, sleeves 9 revolve about support 2 in the way that has been described in the preceding paragraphs, and holding arm 3 rotates with said sleeves 9 and 10, so that seat 5 travels through an arc, and it is due to this rotation of holding arm 3 with respect to support 2, that the eccentricity of connecting piece 14 causes said holding arm 3 to undergo a sliding motion along longitudinal slot 12, which in turn causes tubular member 4 to be pushed due to the passage of its annular slot 13, where said tubular member 4 travels in the axial direction towards support 2, and said longitudinal travel of tubular member 4 causes it to rotate and thus tip the seat 5 attached to it, and this motion takes place thanks to the helical slot 19 which accommodates link 7 from leg 6, which remains in the vertical position due to the fact that it is attached to holding arm 3, and so, summarizing, there is a tipping motion of the seat 5, together with its approaching motion towards support 2, and these motions take place in synchronization and in combination with the circular motion of the seat in an arc, until it reaches its folded position, see FIGS. 10,11,12 and 13, whereupon the seat 5 assumes the tipped position in a plane near to the vertical, and closer to the support 2.

All the different linkages and connections may be constructed in any of the manners which are possible with present day techniques, and in the particular case of the joins from the connecting piece 14 to the support 12, and to the holding arm 3, these may be constructed in accordance with any of the multiple methods that can be utilized, and it is intended that these joins could be constructed by way of ball joints, in order to allow there to be a certain amount of play at said connecting pieces 14 so as to take up any possible maladjustment in their operation.

Moreover, a back-rest 8 is attached to the seat 5 by means of a hinged join, but with the peculiarity that there is a tie bar, one of whose ends is flexibly attached to the leg 6, while the other is pivotally joined to one of the side hinged members, and this tie bar travels obliquely with respect to the longitudinal axis of the holding arm 3, and to that of the tubular member 4. The purpose of this arrangement is that whenever the seat 5 is travelled from the open or operating position to the folded position, or vice-versa, the back-rest 8 is made to fold or unfold respectively in synchronization and in combination with the motion of the seat 5, where such folding or unfolding takes place as the result of the tipping motion of said seat 5, while leg 6 remains in the vertical position, for which reason, during such tipping motion there will in one case be a pull, and in the other there will be a thrust upon the tie bar with respect to the hinged member to which it is pivotally attached, thus causing the back-rest 8 to swivel when it is being either folded or unfolded with respect to seat 5, and as has been stated above, this is a motion which takes place in synchronization with and in combination with the tipping motion of the seat.

It is in this way seen that upward or downward travel of pin 17 will cause the seat 5 both to describe an arch, and to be displaced in a radial direction and to tip, which it does moreover in combination with the folding or unfolding of its backrest 8, so that in this way, and with the need for no other operation, it may travel from its open or seating position, to its folded position, and vice-versa.

It has been mentioned in the preceding paragraphs that the helical slot 15 in sleeve 9 terminates at the bottom in the form of a triangular expansion 18, and a fuller explanation of its purpose can now be provided. In point of fact, enlargement 18 in slot 15 is arranged to have sufficient size so that sleeves 9 are able to revolve through a certain angle without being prevented from doing so by pin 17, so that when the seat 5 is in the open or seating position, it may be slewed in either direction, where such slewing motion involves the rotation of the holding arm 3 and of the sleeves 9 and 10 with respect to support 2; such enlargement 18 being made for the purpose of allowing this motion to take place, and thus prevent the seat from being rigidly slung from the support 2 when it is in the open or seated position, but rather to enable it to be moved through a certain angle in either direction without there being any consequence, so as in this way to facilitate the entry or the exit of the user to and from the seat, and moreover to allow him certain freedom to revolve upon it while he is seated. Moreover, enlargement 15 possess certain height, and this will allow a certain upward and downward movement of the sleeves 9 without being restricted from doing so by pin 17, but such upward and downward movement is only able to take place when the seat is in the unfolded or seating position, and this feature is embodied because the intention is to make the support 2 be attached to the sleeves 9 and 10, and thereby provide them, together with the seat 5, with the possibility of being freely raised or lowered to a certain extent, so that said seat 5 does not rest upon the floor by means of said leg 6, and in this way seat 5 is able to undergo such upward or downward travel in conjunction with the holding arm 3 and the sleeves 9 and 10, without being prevented from doing so by the pin 17, inasmuch as this rides in the gap which is provided in the end of the slot at 18.

Furthermore, the helical slot 19 which comprises the linkage between the tubular member 4 and the holding arm 3, and which defines the tipping motion of the seat 5, is provided with a straight end, and it is this which comes into line with the link 7 when the seat 5 is in the open or seating position, so that the limited slewing motions which this may undergo when in this position, while they may cause there to be certain motion of the tubular member 4 with respect to holding arm 3, will not cause there to be any tipping motion of the seat 5, because of the rectilinear configuration of the slot at this part. Moreover, in this particular construction, said slot 19 is made with the first portion in a rectilinear configuration for the purpose which has been defined, and it then develops into a helical curve in order to make the seat 5 tip, and in order to make the back-rest 8 fold down upon it prior to its having reached a certain point in its travel from the unfolded or seating position to the folded position, so that in the final portion of the travel, no further tipping motion takes place, but nonetheless the configuration of the slot 19 in question may be varied in accordance with requirements, and hence there may be variation in the tipping motion of the seat 5, and in the folding motion of the back-rest 8.

Figure 14:
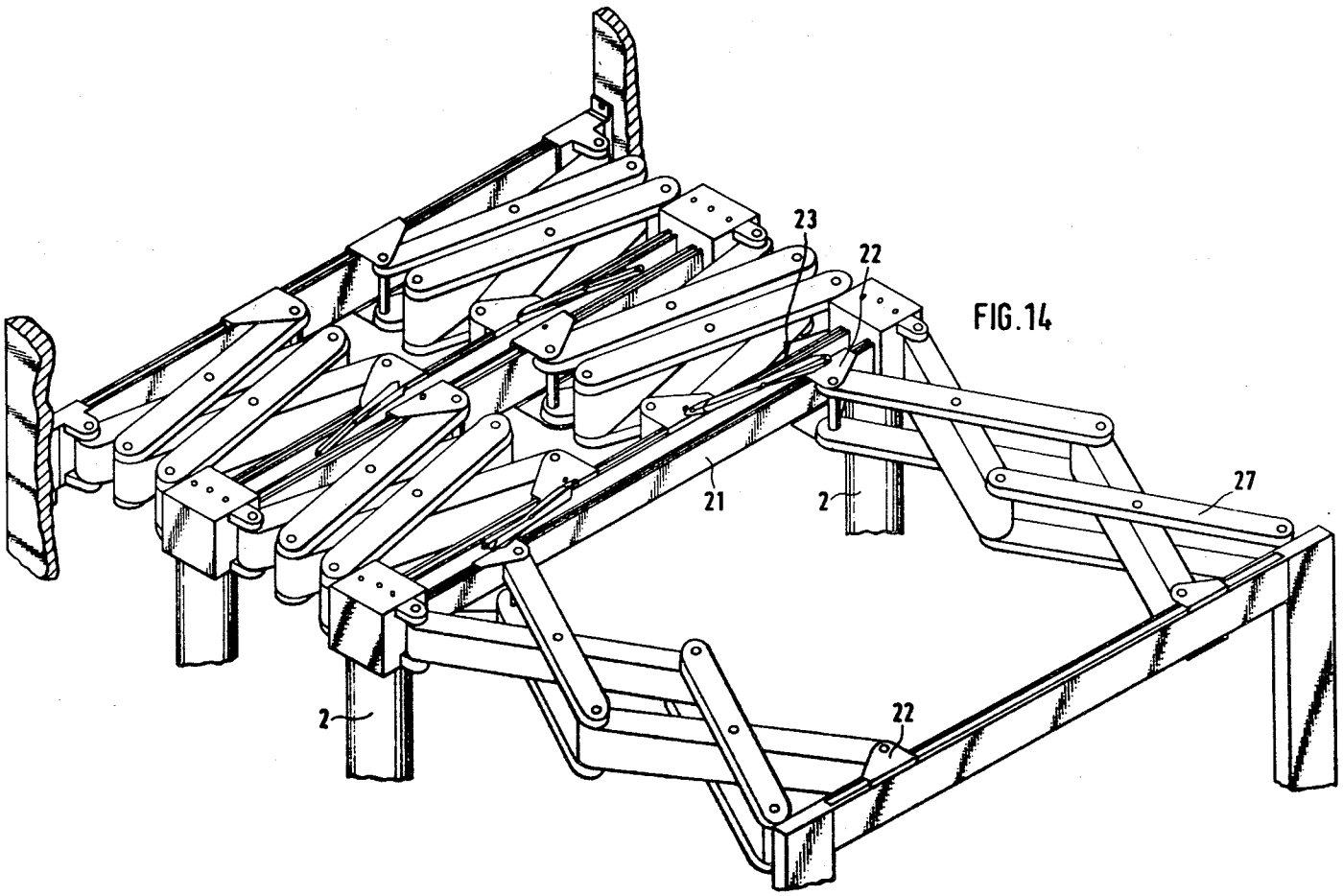
FIG. 14 is a perspective schematic view showing a framework constructed in accordance with the embodiments of the invention.

Each one of the supporting structures is comprised of two columns or legs 2, which are attached together at the upper end by means of a cross member 21, whereas the articulations provided between each two adjoining supporting structures are comprised of a set of pivoted members arranged at each side, where each set is of the double type, that is to say, is made in pairs of scissor members 27, see FIG. 14.

The two pairs of scissor members 27 in each set are each attached together at one end with articulated joints, while one of the arms at the opposite ends is pivotally attached to the respective supporting structure, and the other terminates in a sliding foot 22, which enables it to travel across the respective cross member 21 belonging to the above mentioned structure.

In this way, an articulated and inseparable assembly is formed, which is capable of being folded into the contracted position to take up the minimum space requirements, or alternatively it may be extended in an orderly manner to its open position.

It is to be emphasized that both for the folding and for the unfolding of the framework, no more than a minimal effort is required, and these motions may be carried out either manually or automatically.

Moreover, supporting columns 2 may be provided with means for travelling, being adjustable in height, in order to facilitate the motion of said columns 2 over the surface of the floor, and thus prevent any possible damage to it at the place where the table is located.

Figure 15:
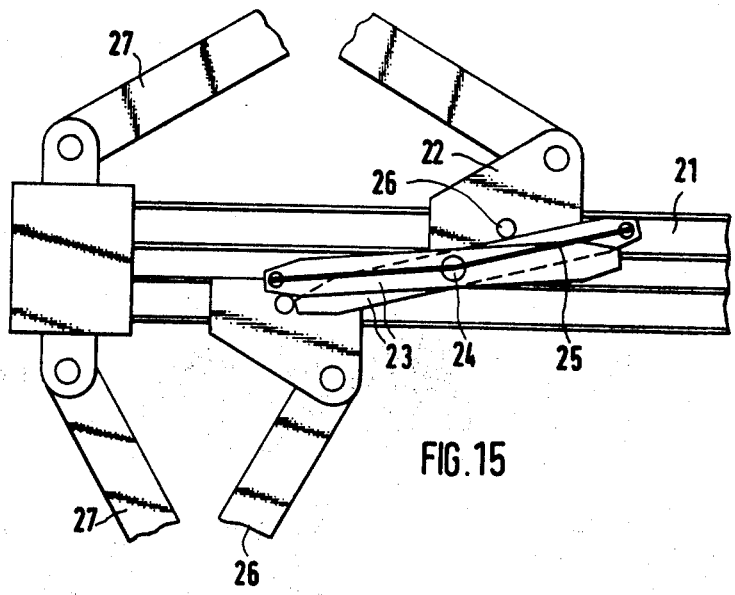
FIGS. 15, 16 and 17 are each detailed plan views showing the arrangement for making the framework fold and unfold in a cascade fashion.
Figure 16:
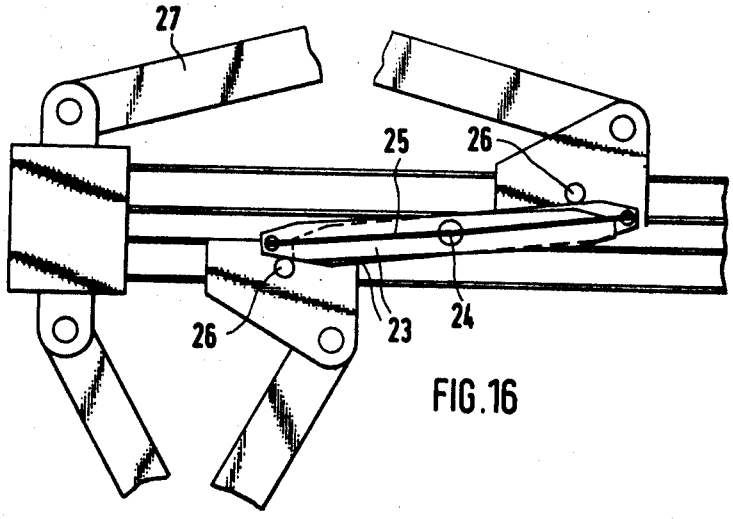
Figure 17:
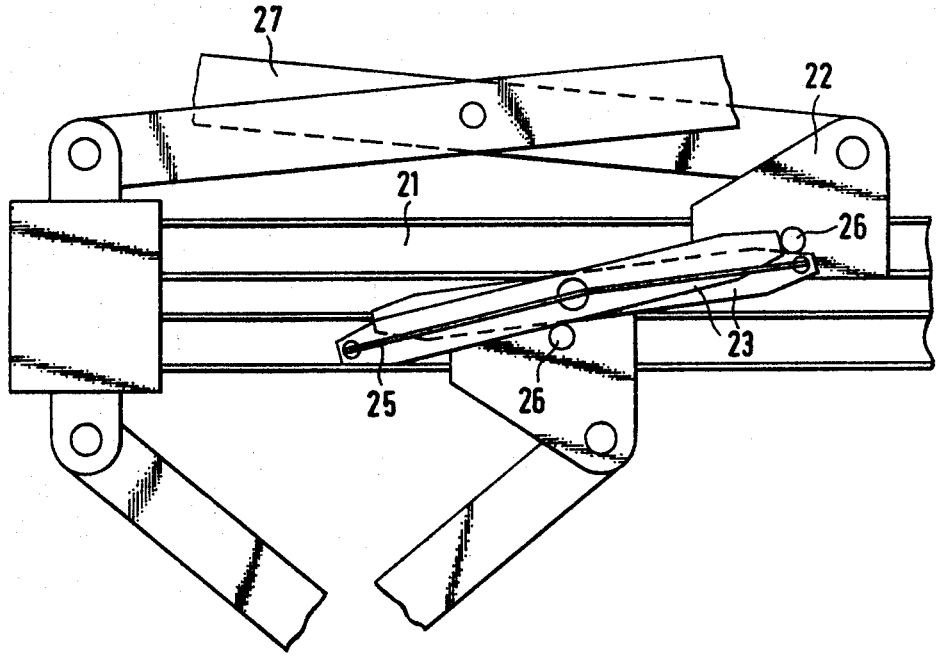
Figure 18:
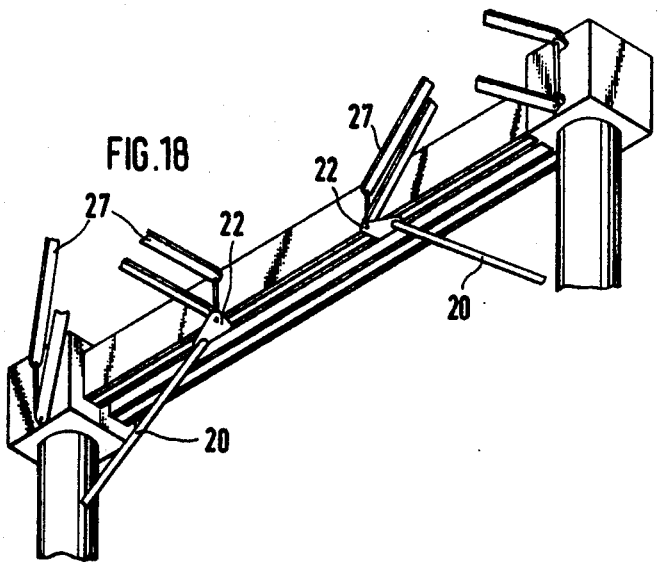
FIG. 18 is a perspective view showing part of the framework seen from below, in order to allow an appreciation of the selective positioning in the assembly of the bars, by means of which the seats are made to fold and unfold.
Figure 19:
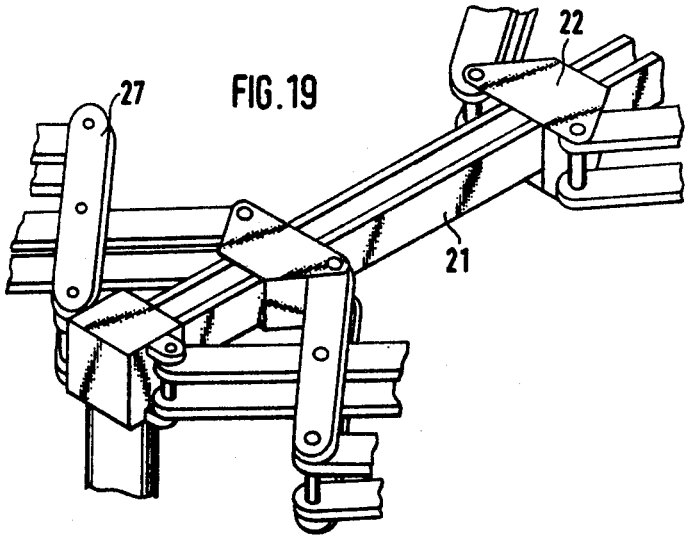
FIG. 19 is a detailed perspective view showing the system used to achieve simultaneous folding and unfolding of the framework.

Moreover, and in accordance with a preferential construction of the invention, each one of the cross members 21 is provided with sets of rocker arms 23, where each one is comprised of two arms rocking about a central pivot 24, through which a spring rod 25 is placed so as to tend to keep said arms 23 in a suitable position, see FIGS. 15, 16 and 17.

From said FIGS. 15, 16 and 17, it may similarly be seen how rocker arms 23 in each set are arranged against the sliding feet 22 belonging to the sliding ends of the respective scissor members 27, and how, upon said sliding feet 22, there are arranged pins 26 in suitable positions with respect to the rocker arms 23.

Commencing from the position illustrated in FIG. 15, where the front scissor member is shown in the wholly unfolded position, while the rear one is in the process of unfolding, it may be appreciated how pin 26 on this latter is in position up against the side of one of the rocker arms 23, whose respective end acts as a stop for pin 26 belonging to the opposing scissor member 27, which thus remains held in its extended position.

When there is motion of the sliding end of scissor member 27, shown in the process of unfolding, then a thrust is exterted through its pin 26 against said rocking arm 23, whereupon this overcomes the pressure of spring 25, see FIG. 16, and rocks, so that when said scissor members 27 are fully folded together, rocker arm 23 adopts the position in which it is shown in FIG. 17, where it may be appreciated how it no longer restricts the sliding motion of the sliding end of the unfolded scissor member 27, which is therefore able to begin to fold together, whereupon the other rocker arm 23 pivots, and thereby acts as a stop for pin 26 belonging to the already folded scissor member 27.

It is in this way that becomes possible for both the folding motion and the unfolding motion of the table always to take place in a cascade fashion; and this means that in order for scissor members 27 placed between two adjoining supporting structures, to start to unfold, it is first necessary for the previous scissor members 27 to have unfolded, and vice-versa when folding is taking place. This peculiarity has a dual advantage, because in addition to its enabling there to be a predetermined order in which the different parts move during the folding and unfolding procedures, which makes for smooth operation, it allows, in the case of a table which on frequent occasions is only partially used (where only a certain area of its total top surface is required), for the table to be partially unfolded, where such unfolding does not take place among all the members comprising it, but rather (and here lies the advantage), only among those belonging to the portion that is withdrawn for use, where these members are all fully unfolded and in position for the table to be used, while the others belonging to that portion of the table which is left unwithdrawn remain fully folded, and take up only the minimum space.

Moreover, in those constructions where the table is provided with automatic operation for the motion of the seats, a preferred embodiment is envisaged wherein some of the sliding feet 22 are coupled to tie bars 20, by which means it becomes possible at the same time as the folding or unfolding motion of the framework is taking place, for the different members comprising the seat mechanisms to be undergoing motion too, so that said seats will move respectively from the operational or seating position to the folded position, or vice-versa.

I claim:

1. In a folding seat and table unit of the type having a plurality of seats and a table connected together into an articulated unit, said table being adapted to extending and retracting, the improvement comprising:

(a) a plurality of substantially vertical legs on said table;

(b) at least one seat;

(c) connecting means for connecting said at least one seat to a corresponding one of said legs;

(d) folding and unfolding means on said connecting means for pivoting said seat between an unfolded position and a folded position about the axis of said one of said legs;

(e) pivot means on said means for connecting for rotating said seat from a substantially horizontal position to a substantially vertical position during motion by said folding and unfolding means from said first position to said second position; and (f) unfolding framework means on said table for moving at least some of said legs closer to some others thereof while maintaining all of said legs substantially vertical and parallel.

2. A folding seat and table unit, in full accordance with claim 1 further comprising an unfolding framework in said table connected to said folding and unfolding means operative to move said seats between their folded and their unfolded positions simultaneously and in relation with the movements for extending and retracting the table.

3. A folding seat and table unit, in accordance with claim 1 wherein said unfolding framework means comprises a horizontal row of upright supporting structures, each one of which is joined to its adjacent structures by means of articulated scissor-like members, some of whose ends comprise a coupling in said upright structures, where said coupling is capable of sliding within guides said supporting structures and scissor-like members forming an articulated and inseparable body that can be withdrawn into its open position for use, or retracted when not in use, so as to adopt a small and compact volume.

4. A folding seat and table unit, in full accordance with claim 3, further comprising rocker arms, each rocker arm being positioned by a sliding foot on the end of the respective articulated scissor member, said rocker arms being operative to lock the sliding foot on the scissor member with respect to the preceding one, or allow it to be freely displaced, so as thus to enable the framework to be folded and unfolded in cascade fashion.

5. A folding seat and table unit in full accordance with claim 3 inter-related sliding feet of respective scissor members may be directly linked to one another in order for the different scissor members to be interrelated, so that both during the folding as well as during the unfolding motion, there is a simultaneous movement of the different parts comprising the framework.

6. A folding seat and table unit, in full accordance with claim 3 further comprising some of said scissor members having mechanical means for engagement with said seating means, operative to obtain simultaneous and co-related movements during the folding and unfolding of the framework, among the parts comprising the seating means in order for these too to move from the open to the folded position, and vice-versa.

7. A folding seat and table unit in full accordance with claim 1 wherein said unfolding framework means comprises a plurality of pairs of feet which are joined adjacently to one another by means of extendable and retractable telescopic stringer members, a foldable table-top on said framework means, said framework means and top forming an articulated and inseparable unit that can be folded by means of clustering the pairs of feet on the framework, so that they are drawn towards one another when the telescopic joining members are retracted and means for simultaneously folding the table-top and the seats in conjunction with the feet in a single and simultaneous folding motion of the whole assembly as a single unit, said seats being folded away inside the framework, where they become accommodated between said legs in an operation that may be simultaneous with and dependent upon the folding motion of the frame.

8. A folding seat and table unit, in accordance with claim 7 further comprising said seat being linked to an outside support, rotating sleeves on said outside support attached to a holding arm, a helical slot in one of said sleeves, a fitted actuating pin in said helical slot adapted to upward and downward travel, which is slidingly attached to a leg in the vertical plane, a straight slot in said leg said actuating pin also passing through said straight slot so that in the course of upward and downward motions said actuating pin exerts a sideways thrust against the helical slot causing said sleeve members to revolve together with the holding arm and the seat so as to make said seat move from its open or seating position, to the withdrawn or concealed position, and vice-versa, where such movement of said seat takes place along the line of the arc of a circle, said seat being connected to a telescopic tubular member on said holding arm, a helical slot in said tubular member a linkage from said holding arm to said tubular member said linkage being operative as the result of the rotation of the holding arm with respect to the support, to cause the tubular member to travel axially in one or other direction, which motion makes said tubular member rotate due to the linkage it has by virtue of the helical slot with holding arm, so that whenever there is an upward or downward motion of said fitted actuating pin accommodated in the helical slot in said sleeve the seat is made to move and describe an arc, and it at the same time is made to tip and move in the radial direction during the course of its automatic motion from the folded to the open or seating position and vice-versa.

9. A folding seat and table unit in accordance with claim 8 wherein said linkage comprises a connecting piece 14, one of whose ends is flexibly attached to the leg (support), whilst the other is slidingly linked to a longitudinal slot in the holding arm, said other end going through an annular slot in the tubular member in an eccentric arrangement that allows there to be a pull or a thrust exerted whilst the holding arm is in rotation about the leg.

10. A folding seat and table unit, in full accordance with claim 8 further comprising a triangular expansion configuration at the lower end of said helical slot in said sleeve, and wherein said fitted pin is accommodated whilst the seat is in the unfolded or seating position.

11. A folding seat and table unit, in full accordance with claim 10 wherein the expansion at the termination of the helical slot in the sleeves on the leg, contains means for allowing play for the pin in the vertical direction, said sleeved being operative to descend under the weight of a person, said seat being supported upon the floor through its own leg.

12. A folding seat and table unit, in full accordance with claim 11 further comprising a rectilinear portion in the helical groove which comprises the linkage between the tubular member 4 and the holding arm 3 said rectilinear portion in the axial direction at that one of the ends of said helical groove which is in use when the seat is in the open or seating position.

13. The apparatus recited in claim 1 further comprising:

(a) a back rest pivotally connected to said seat; and (b) erecting and folding means for erecting said back rest when said seat is in its unfolded position and for folding it toward said seat when said seat moves a predetermined distance from its unfolded position toward its folded position.

14. A folding seat and table unit in accordance with claim 9 further comprising a vertical leg below the centre of said seat, said vertical leg being connected to said holding arm through the helical slot in said tubular member, a back rest hingeably attached to said seat, linkage means between said vertical leg and said back rest for folding said back rest during folding of said seat and unfolding said back rest during unfolding of said seat.

* * * * *